US005227078A

United States Patent [19]

Augustine, III

[11] Patent Number: 5,227,078

[45] Date of Patent: Jul. 13, 1993

[54] FLOW-VECTORED DOWNSPOUT ASSEMBLY AND METHOD FOR USING SAME

[75] Inventor: Robert B. Augustine, III, Richmond, Va.

[73] Assignee: Reynolds Metals Company, Richmond, Va.

[21] Appl. No.: 886,557

[22] Filed: May 20, 1992

[51] Int. Cl.[5] ..... B22D 35/00

[52] U.S. Cl. ..... 222/606; 164/437

[58] Field of Search ..... 164/437, 488, 489, 337, 164/133; 222/591, 606, 607

[56] References Cited

U.S. PATENT DOCUMENTS

| | | | |
|---|---|---|---|
| 3,511,304 | 5/1970 | Baier | 164/489 |
| 3,517,726 | 6/1970 | Mills | 164/437 |
| 3,951,317 | 4/1976 | Hosokawa et al. | 164/437 |
| 3,995,682 | 12/1976 | Fekete et al. | 164/437 |
| 4,662,546 | 5/1987 | Mosser et al. | 222/591 |
| 4,724,896 | 2/1988 | Rose et al. | 164/437 |

FOREIGN PATENT DOCUMENTS

| | | | |
|---|---|---|---|
| 0106456 | 7/1982 | Japan | 222/591 |
| 0076752 | 4/1988 | Japan | 222/606 |
| 0187240 | 7/1990 | Japan | 164/488 |
| 0588059 | 1/1978 | U.S.S.R. | 164/437 |

*Primary Examiner*—Richard K. Seidel
*Assistant Examiner*—James Miner
*Attorney, Agent, or Firm*—Alan M. Biddison

[57] ABSTRACT

A flow-vectored downspout includes a pouring tube and a flow diffuser arranged on an end thereof. The flow diffuser includes horizontal slots disposed toward the faces of an ingot during a continuous casting process with horizontal and angled slots disposed toward the ingot sides. The flow diffuser also includes at its bottom a domed diverter which facilitates transition of vertical molten metal flow through the pouring tube into a substantially horizontal flow pattern for discharge into a mold cavity through the arrangement of horizontal and angled slots. The particular arrangement of slots provides distribution to all areas of the ingot to be cast with minimal turbulence. The flow-vectored downspout is especially adapted for direct chill or electromagnetic casting without the use of a channel bag or the like. A continuous casting method using the downspout is also provided.

12 Claims, 4 Drawing Sheets

FLOW-VECTORED DOWNSPOUT ASSEMBLY AND METHOD FOR USING SAME

FIELD OF THE INVENTION

The present invention relates to a flow-vectored downspout, and in particular, a flow diffuser arranged on the distal end of a downspout. The flow diffuser includes a flow-vectored design to redirect vertical molten metal flow into a less turbulent substantially horizontal and fan-shaped flow for continuous casting of metals, in particular, aluminum alloys.

BACKGROUND OF THE INVENTION

In the continuous casting of metals, in particular, steel or aluminum, introduction of flowing molten metal into a mold cavity requires precise control to avoid detrimental effects on the quality of the cast product. Variables such as quantity of metal introduced in the mold cavity, distribution of molten metal during the pouring sequence, heat loss and oxidation rates all affect product quality.

In order to provide acceptable levels of quality in cast products, pouring tubes or downspouts have been developed to introduce molten metal in a submerged manner.

Submerged-type continuous casting nozzles or downspouts typically include passageways on the distal end thereof to direct flow of molten metal in a particular direction. U.S. Pat. No. 3,996,994 to Schrewe et al. discloses a feeder pipe for a mold for continuous casting of steel which has a near-rectangular inner and outer contour with oppositely directed discharge ports for feeding toward the small sides of a mold.

U.S. Pat. No. 4,993,608 to Thörner discloses a pouring tube for the introduction of a metallic melt into a strip-casting mold which includes a plurality of vertically aligned slots arranged near the distal end of the pouring tube.

U.S. Pat. Nos. 4,671,433 to Podrini et al. and 4,858,794 to Sugiura et al. disclose submerged nozzles for continuous casting which include angled discharge ports located at the nozzle tip.

U.S. Pat. No. 4,487,251 to Cahoon et al. discloses a nozzle for a continuous casting apparatus which includes facilities for passing a fluid medium, e.g. argon, through its wall members transverse to the direction of molten metal flow to retard accumulation of undesirable formations such as metal oxides.

U.S. Pat. No. 4,819,840 to Lax et al. discloses a refractory submerged pouring nozzle having a bottom plate and two opposing outflow orifices. Each outflow orifice has a roof-shaped guide element projecting outwardly. The nozzle also includes a vertex and guide surface on the bottom plate thereof.

Downspouts are also employed in direct chill or electromagnetic continuous casting of aluminum alloys. However, continuous casting of aluminum alloys is sensitive to excessive contact with the atmosphere caused by turbulence and/or splashing during pouring of molten aluminum using a downspout. This excessive contact results in the formation of oxides of the molten metal which float to the top of the molten metal or remain in the ingots as impurities. Excessive oxides on the top of the molten metal require complicated ingot head skimmers and mechanical skim dams. Impurities remaining in the ingot require extensive conditioning work such as scalping to prepare the ingot surface for further working operations.

In response to the deficiencies in downspout designs in these types of continuous casting processes, channel bags are utilized in conjunction with a downspout to minimize turbulence during the casting process. With reference now to FIG. 1, a downspout in combination with a channel bag is generally designated by the reference numeral 100 and seen to include a downspout 101 extending below the surface 105 of molten metal that is being solidified to form an ingot 103 being cast. The channel bag 107 is configured to direct flow of the molten metal, as indicated by the arrows within the chamber created by the channel bag 107, toward the small sides 109 of the ingot 103.

Although channel bags assist in specific distribution of the molten metal during continuous casting, several drawbacks exist when utilizing channel bags during casting. During start-up operations of the continuous casting, the channel bags may stick to the starter block. During casting of high magnesium content aluminum alloys, the channel bags may clog which obstructs flow of molten metal into the ingot. Furthermore, oxides formed on the top surface of the molten metal in the mold cavity may periodically release through the sides of the channel bag and accumulate on the long face of the ingot causing cracking or other surface defects.

In view of the disadvantages associated with channel bags, a need has developed to improve molten metal distribution, reduce turbulence and eliminate the drawbacks associated with channel bags in continuous casting processes, especially direct chill or electromagnetic continuous casting of aluminum alloys.

In response to this need, the present invention provides a flow-vectored downspout for continuous casting which includes a flow diffuser arranged at the distal end of a downspout. The flow diffuser includes a series of slots configured in a particular manner and specially configured bottom plate to vector molten metal flow to all vital areas of the ingot head while reducing turbulence and eliminating the need for a channel bag during casting.

SUMMARY OF THE INVENTION

It is accordingly one object of the present invention to provide an improved flow-vectored downspout for use in continuous casting apparatus, in particular, direct chill or electromagnetic casting of aluminum alloys.

It is a further object of the present invention to provide an improved flow-vectored downspout which includes a flow diffuser at the tip of the downspout which transitions vertical molten metal flow into a less turbulent horizontal fan-shaped flow.

It is a further object of the present invention to provide a flow-vectored downspout in direct chill or electromagnetic continuous casting of aluminum alloys which eliminates the requirement of using a channel bag with a downspout.

Other objects and advantages of the present invention will become apparent as the description thereof proceeds.

In satisfaction of the foregoing objects and advantages, there is provided by the present invention a flow-vectored downspout for use in continuous casting of molten metal comprising a pouring tube having a passageway therethrough and a flow diffuser arranged on the end of the pouring tube and in communication with the passageway. The flow diffuser comprises a cylindrical body having a series of openings or slots in opposing faces thereof.

In one embodiment the pouring tube has a reduced diameter or constricted portion that cooperates with a conventional flow control pin to control the rate of metal flow through the downspout. Preferably, the cross sectional area of the openings in the faces of the flow diffuser is greater than the cross sectional area of the constricted portion of the pouring tube so that the constricted portion, rather than the openings, controls the rate of metal flow into the mold cavity. The openings in the portions of the flow diffuser facing the short sides of the mold cavity have a greater cross sectional area than the openings in the portions of the flow diffuser facing the long sides of the mold cavity. As a result, more molten metal is directed towards the short sides than is directed to the long sides.

With one embodiment of the invention, a first pair of opposing faces of the flow diffuser include horizontal slots therethrough and are configured toward an ingot face during casting. A second pair of opposing faces include both horizontal and angled slots and are configured toward the short sides of an ingot to be cast.

The bottom of the flow diffuser includes a domed diverter which transitions vertical molten metal flow from the passageway toward the horizontal and angled slots. Molten metal passes out the angled slots in a less turbulent and horizontal fan-shaped flow pattern which facilitates placement of hot metal to specific areas within the ingot head.

In one embodiment, the flow diffuser may be an integral part of the pouring tube. In another embodiment, the flow diffuser may include features to permit removable attachment to the pouring tube.

BRIEF DESCRIPTION OF DRAWINGS

Reference is now made to the Drawings accompanying the invention wherein.

DESCRIPTION OF THE PREFERRED EMBODIMENTS

The present invention is directed to a flow-vectored downspout for use in continuous casting of molten metals. The flow-vectored downspout redirects the vertical velocity of metal flowing down a downspout and transitions it into a less turbulent horizontal fan-shaped flow. The fan-shaped flow is achieved by the use of horizontal and angled slots arranged in opposing faces along the lower end of the flow-vectored downspout.

The bottom end of the flow-vectored downspout includes a diverter which forces all incoming molten metal toward the slots in the faces. The slot arrangement is designed to encourage preferential flow through two sets of slots in one pair of opposing faces while permitting a reduced flow to the slots in the other pair of opposing faces.

The flow-vectored downspout transitions molten metal from a vertical flow plane to a horizontal flow plane while facilitating select placement of molten metal to specific areas within an ingot head. The flow-vectored downspout is especially adapted for direct chill or electromagnetic casting operations for aluminum alloys since it is capable of distributing metal flow to all vital areas of an ingot head while minimizing turbulence such that the continuous casting operation can be performed without the use of a channel bag.

Figure 1:
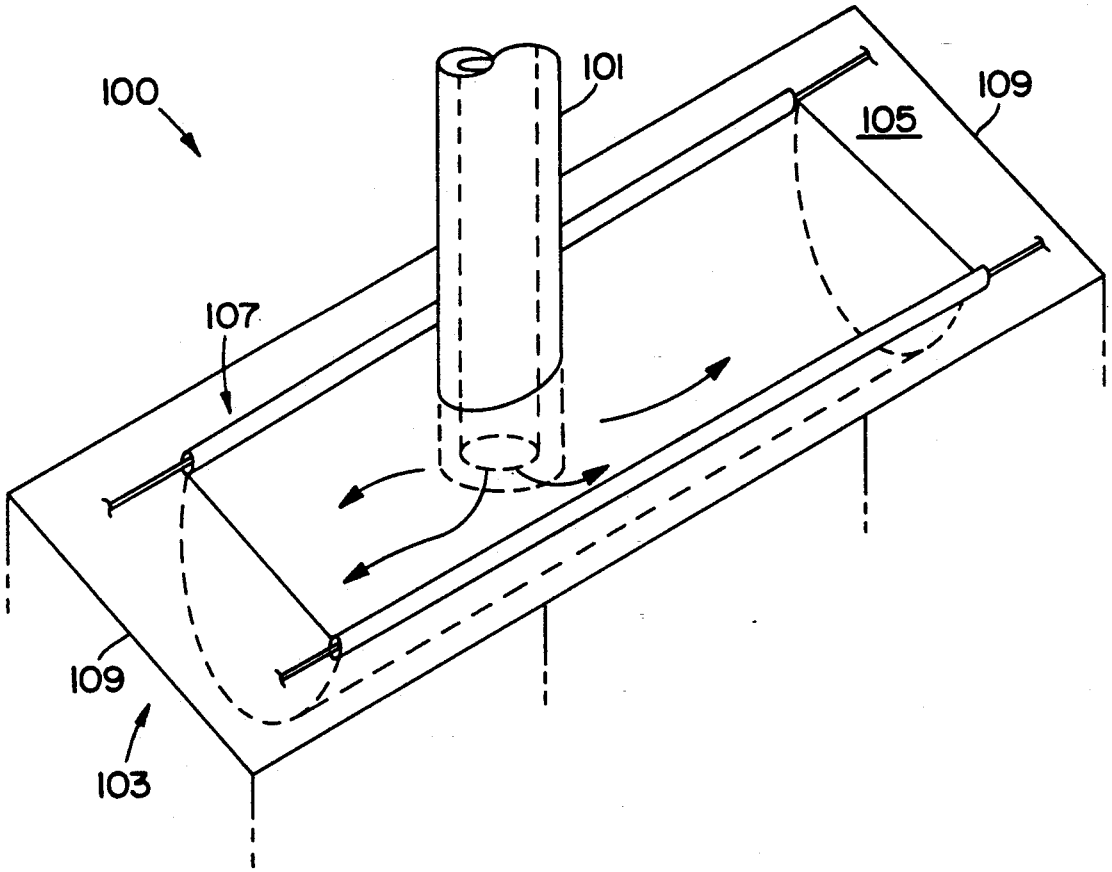
FIG. 1 PRIOR ART
FIG. 1 shows a perspective view of a prior art design including the combination of a downspout and channel bag for direct chill or electromagnetic continuous casting.
Figure 2:
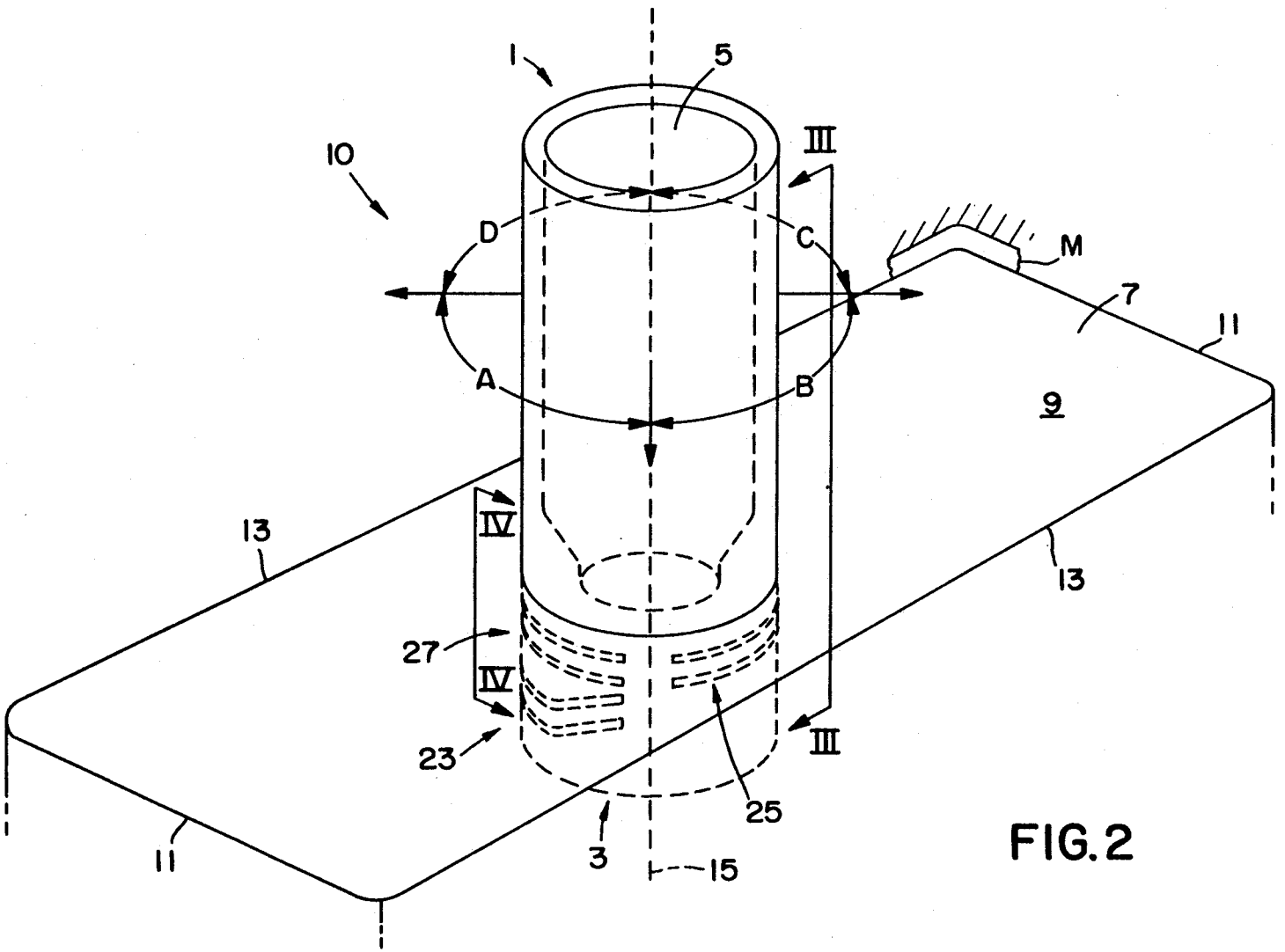
FIG. 2 shows a perspective view of one embodiment of the present invention submerged in an ingot head during a typical casting sequence.

With reference now to FIG. 2, a first embodiment of the flow-vectored downspout for charging a cavity of a mold M with a molten metal during a continuous casting operation is generally designated by the reference numeral 10 and is seen to include a pouring tube 1 and a flow diffuser 3. The pouring tube 1 is generally cylindrical in shape and includes a passageway 5 therethrough having a predetermined cross-sectional area. The flow passageway 5 provides a channel for directing molten metal from a tundish or the like (not shown) to the flow diffuser. As will be described in greater detail hereinafter, the flow diffuser 3 transitions the vertical molten metal flow from the passageway 5 in a submerged manner to the head of ingot 7.

The flow-vectored downspout 10 is shown, in an exemplary use, as providing a submerged flow of molten metal to the top portion of a molten metal pool 9 that is progressively solidified to form an ingot being continuously cast. The ingot 7 has short opposing sides 11 and opposing ingot faces 13.

The flow-vectored downspout is divided into four generally equal faces designated by the letters A, B, C and D in FIG. 2. Since the pouring tube 1 is generally cylindrical in nature, each face represents an arc length subtended by a 90° angle based upon the axis 15 of the passageway 5.

Face A and opposing face C constitute a pair of opposing second faces, each including a pair of slots 21 that are preferably horizontal and disposed above a pair of non-linear or angled slots 23.

In contrast, face B includes a pair of slots 25 that are preferably horizontal. Opposite face D also includes an identical and opposing pair of slots (not shown). Faces B and D together comprise a pair of opposing first faces.

While pairs of openings are illustrated, it should be readily apparent that other slot configurations are encompassed by the present invention. There could be one, two or more openings in each face. The cross sectional area of the slots in faces A and C should be greater than the cross sectional area of the slots in faces B and D so more metal is directed to the short faces of the ingot being cast than is directed to the long or rolling faces of the ingot. Also, the slots can extend either horizontally or at an angle through the side walls of the flow diffuser. It has been found that use of angled slots close to bottom of the flow diffuser helps in the non-turbulent transition of vertical molten metal flow to horizontal molten metal flow.

Figure 3:
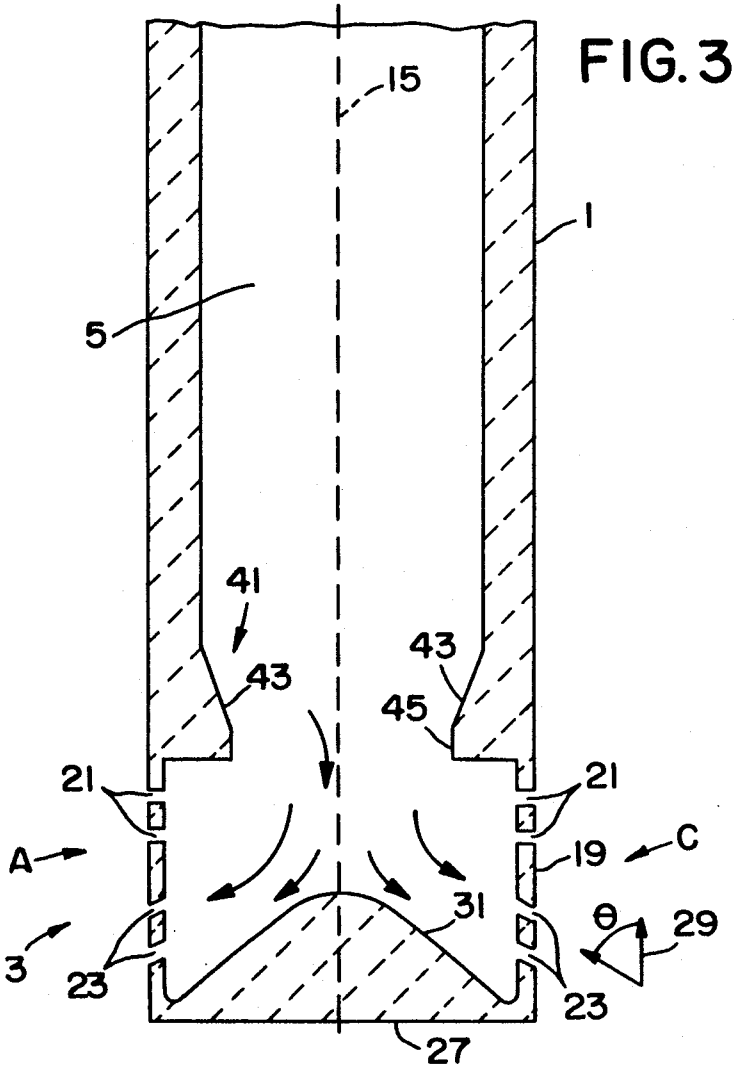
FIG. 3 shows a cross-sectional view along the line III—III depicted in FIG. 2.

With reference now to FIG. 3, the cross-sectional view along the line III—III of FIG. 2 more clearly illustrates the particular configuration of the slots 21 and 23 in the flow diffuser 3. As can be seen from FIG.

3, the flow diffuser 3 includes a sidewall 19 and a bottom 27. Opposing pairs of slots 21 extend through the sidewall 19 in a preferably horizontal fashion. The lower slots 23 extend through the sidewall 19 in a preferably downwardly angled configuration. As shown in FIG. 3, the downward angulation of the slots 23 is represented by the angle Θ between a vertical orientation 29 and the actual slot angulation. The angle Θ may range between 0° and 30° with a preferred angle for the slots 23 including 25° from vertical.

The flow diffuser 3 also includes a domed diverter 31 which assists in transition of the vertical molten metal flow through the passageway 5 to a horizontal and fan-shaped flow through the slots 21, 23 and 25. Moreover, the combination of the four downwardly angled slots 23 and the domed diverter 31 create a softer transitional flow pattern from the vertical plane to a horizontal plane.

With reference now to FIGS. 2 and 3, the faces A and C with opposing horizontal and angular slots provide a predominant flow characteristic and vector flow toward the ingot side ends 11 with a reduced flow toward ingot faces 13.

Figure 4:
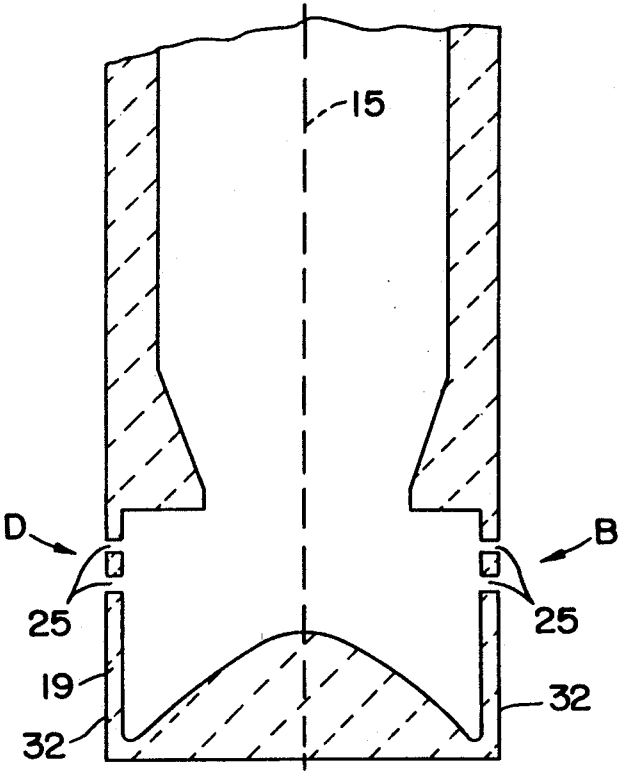
FIG. 4 shows a cross-sectional view taken along the line IV—IV depicted in FIG. 2.

With reference now to FIG. 4, the orientation of the slots 25 on faces B and D is depicted. The slots 25 are similar to slots 21 in that they horizontally extend through the side wall 19. By including only two slots in the B and D faces of the flow-vectored downspout, a more reduced flow is directed to the ingot rolling faces 13. As a result of the reduced molten metal flow toward the ingot faces 13 via the slots 25 and the increased vector flow toward the ingot sides 11 via the slots 21 and 23, improved distribution of molten metal flow to all vital areas of the ingot head is achieved. Moreover, the flow vectoring as a result of the slot configurations and domed diverter produces a less turbulent flow which minimizes ingot defects by reducing excessive oxidation and minimizing or eliminating extensive ingot reconditioning steps.

With reference now to FIG. 3, the pouring tube 1 includes a portion of decreasing diameter 41 having a tapered face 43 and a vertical face 45. The tapered face 43 provides a contact surface for a flow control pin (not shown) extending through the passageway 5 for control of molten metal flow in a manner well known to those skilled in the art. As will be described hereinafter, the vertical face 45 can be utilized in conjunction with another embodiment of the present invention. Of course, other control devices may be used in conjunction with the pouring tube 1 such that the passageway 5 is uniform in cross-section along the length thereof.

Figure 5:
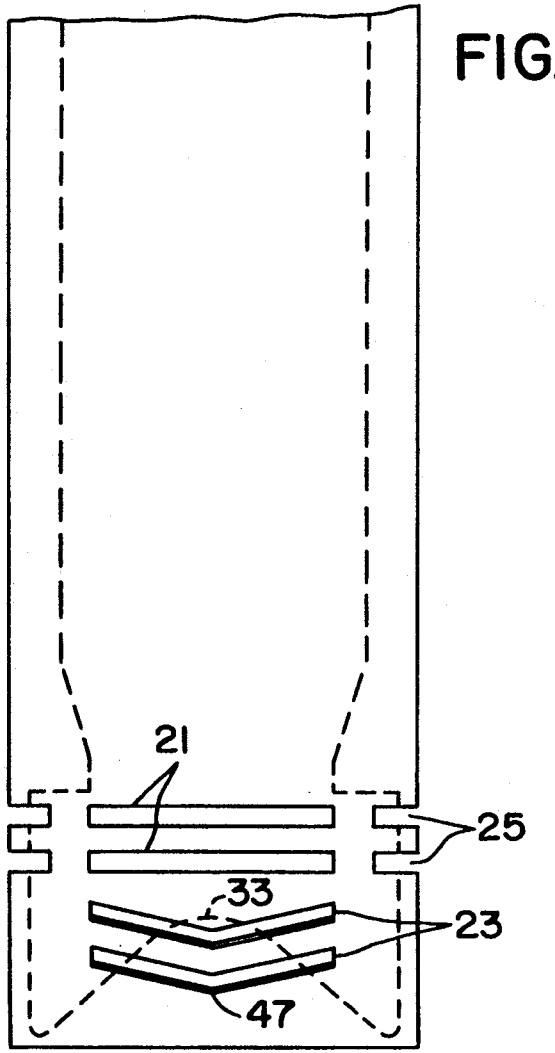
FIG. 5 shows a side view of one embodiment of the flow-vectored downspout, the side view depicting face A as shown in FIG. 2.

FIG. 5 illustrates a side view of one embodiment of the flow-vectored downspout and more clearly illustrates the angled configuration of the lower slots 23. In this embodiment, the lower slots 23 are generally V-shaped such that the center portion 47 of each slot extends below the peak of the dome 33 of the diverter 31. In this manner, improved transitional flow from vertical to horizontal is achieved. It should be understood that the V-shaped configuration of the slots 23 depicted in FIG. 5 may be substituted with a U-shaped configuration such that the center portion is curved rather than angled as depicted by the V-shaped slots in FIG. 5.

Figure 6:
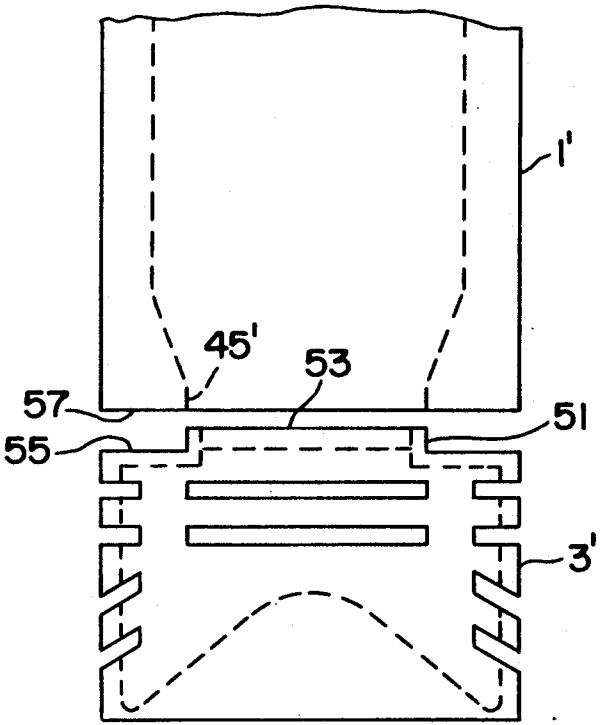
FIG. 6 shows a side view of another embodiment of the present invention illustrating a removably attachable flow diffuser.

The embodiment of the flow-vectored downspout depicted in FIGS. 2–5 shows the pouring tube 1 to be integrally connected to the flow diffuser 3 such that the flow-vectored downspout is of one-piece construction. Alternatively, the flow diffuser 3 may be separable from the pouring tube 1. With reference now to FIG. 6, one embodiment of a separable or removable flow diffuser in combination with a pouring tube is depicted. In FIG. 6, the flow diffuser is generally designated by the reference numeral 3′ and is seen to include a male connecting portion 51 having external threads 53 thereon. The vertical face 45′ of the pouring tube 1′ includes threads thereon (not shown) which permit threadable engagement between the pouring 1′ and the flow diffuser 3′.

It should be understood that other known methods for attaching the flow diffuser 3′ to the pouring tube 1′ may be utilized. For example, the male portion 51 may be eliminated such that the upper face 55 of the flow diffuser 3′ may be joined to the lower face 57 of the pouring tube 1′ using conventional techniques such as an adhesive or joining compound having sufficient temperature resistance to the molten metal environment. Alternatively, the flow diffuser 3′ may be attached to the pouring tube 1′ using conventional fasteners. In one example, the male 51′ may be secured against the vertical face 45′ using a plurality of pins extending radially through the pouring tube walls and into the male portion 51′. By providing a removable flow diffuser 3′, the flow diffuser 3′ may be removed for maintenance or replacement without the necessity of removing or replacing the entire pouring tube 1′. The removability aspect of the flow diffuser 3′ provides further advantages over prior art designs since the transition from vertical to horizontal molten metal flow is more likely to erode the flow diffuser 3′ rather than the pouring tube 1′. The removable feature of the flow-vectored downspout facilitates repair or replacement of a potentially high maintenance component in continuous casting operations.

In a currently preferred embodiment, as schematically illustrated by the dashed lines 32 in FIG. 4, the bottom of the flow diffuser containing the domed diverter 31 is releasably connected to the side wall of the flow diffuser to facilitate separation of the diverter 31 from the side wall after use. Removal of the diverter simplifies its cleaning prior to its next use.

The inventive flow-vectored downspout may be made of any material, with a preferred material including refractory compositions typically utilized in prior art downspout designs. In the embodiment utilizing a removably attachable flow diffuser and pouring tube, the flow diffuser is preferably made of the same material as the pouring tube such that problems as a result of dissimilar materials and varying rates of thermal expansion are avoided.

The total cross-sectional area for all of the slots 21, 23 and 25 should be at least equal to the maximum downspout flow control orifice open area. Preferably, the total slot opening area is greater than the maximum downspout flow control orifice open areas. The flow control orifice open area, in one example would correlate to the smallest cross-sectional area in the pouring tube, e.g., the area between the vertical faces 45 as shown in FIG. 3.

An insufficient amount of slot area would restrict molten metal flow through the slots and disrupt molten metal flow distribution, thereby degrading the quality of the continuous cast product.

As such, an invention has been disclosed in terms of preferred embodiments thereof which fulfill each and every one of the objects of the present invention as set forth hereinabove and provides a new and improved flow-vectored downspout which eliminates the requirement of a channel bag in continuous casting operations such as direct chill or electromagnetic casting of aluminum alloys.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A flow-vectored downspout for charging a mold cavity with a molten metal during a continuous casting operation comprising:

a) a pouring tube having a passageway, said passageway having a predetermined flow control cross-sectional area; and b) a flow diffuser arranged at an end portion of said pouring tube, said flow diffuser further comprising a cylindrical body having an open top in communication with said passageway, a side wall and a bottom;

c) wherein said side wall is divided into a pair of opposing first faces and a pair of opposing second faces, each said first face having a first pair of slots therethrough, each said second face having a second pair of slots therethrough and a pair of non-linear slots therethrough having a shape different from the shape of said second pair of slots, each of said first pair of slots and each of said second pair of slots extending horizontally through said side wall, each said pair of non-linear slots being arranged below each said second pair of slots in each said second face and extending through said side wall at a downward angle from the interior to the exterior of said flow diffuser; and d) means arranged on said bottom for transitioning vertical flow of molten metal from said passageway to a horizontal flow toward each of said slots;

e) each said first face arranged on said flow diffuser toward an opposing long side of said mold cavity and each said second face arranged on said flow diffuser toward an opposing short side of said mold cavity;

f) wherein said flow diffuser provides reduced turbulence and a horizontal fan-shaped flow of molten metal in said mold cavity during continuous casting.

2. The flow-vectored downspout of claim 1 wherein said downward angle is less than 30 degrees from vertical.

3. The flow-vectored downspout of claim 1 wherein said means for transitioning vertical flow of molten metal further comprises a dome.

4. The flow-vectored downspout of claim 1 wherein said flow diffuser and said pouring tube are integrally connected.

5. The flow-vectored downspout of claim 1 wherein said flow diffuser has at least a portion thereof removably attached to a remainder portion of said downspout.

6. The flow-vectored downspout of claim 5 wherein said removably attachable portion includes means for threadably engaging the remainder portion of said downspout.

7. The flow-vectored downspout of claim 1 wherein each of said first and second pair of slots and each said pair of non-linear slots comprise a cross-sectional area opening greater than said predetermined flow control cross-sectional area of said pouring tube.

8. The flow-vectored downspout of claim 7 wherein said predetermined flow control cross-sectional area of said pouring tube is a minimum flow control orifice opening.

9. The flow-vectored downspout of claim 1 wherein said mold cavity further comprises a direct chill or electromagnetic continuous casting mold cavity and each said short side corresponds to a cast ingot short side and each said long side corresponds to an ingot face.

10. The flow-vectored downspout of claim 1 wherein each of said first faces and each of said second faces correspond to an arc length along an outer circumference of said flow diffuser, each said arc length being equal.

11. A flow-vectored downspout for charging a mold cavity with a molten metal during a continuous casting operation comprising:

a) a pouring tube having a passageway, said passageway having a predetermined flow control cross-sectional area; and b) a flow diffuser arranged at an end portion of said pouring tube, said flow diffuser further comprising a cylindrical body having an open top in communication with said passageway, a side wall and a bottom;

c) wherein said side wall is divided into a pair of opposing first faces and a pair of opposing second faces, each said first face having a first pair of slots therethrough, each said second face having a second pair of slots therethrough and a pair of V-shaped slots therethrough, each said pair of V-shaped slots being arranged below each said second pair of slots in each said second face; and d) means arranged on said bottom for transitioning vertical flow of molten metal from said passageway to a horizontal flow toward each of said slots;

e) each said first face arranged on said flow diffuser toward an opposing long side of said mold cavity and each said second face arranged on said flow diffuser toward an opposing short side of said mold cavity;

f) wherein said flow diffuser provides reduced turbulence and a horizontal fan-shaped flow of molten metal in said mold cavity during continuous casting.

12. A flow-vectored downspout for charging a mold cavity with a molten metal during a continuous casting operation comprising:

a) a pouring tube having a passageway, said passageway having a predetermined flow control cross-sectional area; and b) a flow diffuser arranged at an end portion of said pouring tube, said flow diffuser further comprising a cylindrical body having an open top in communication with said passageway, a side wall and a bottom;

c) wherein said side wall is divided into a pair of opposing first faces and a pair of opposing second faces, each said first face having a first pair of slots therethrough, each said second face having a second pair of slots therethrough and a pair of U-shaped slots therethrough, each said pair of U-shaped slots being arranged below each said second pair of slots in each said second face; and d) means arranged on said bottom for transitioning vertical flow of molten metal from said passageway to a horizontal flow toward each of said slots;

e) each said first face arranged on said flow diffuser toward an opposing long side of said mold cavity and each said second face arranged on said flow diffuser toward an opposing short side of said mold cavity;

f) wherein said flow diffuser provides reduced turbulence and a horizontal fan-shaped flow of molten metal in said mold cavity during continuous casting.

* * * * *